United States Patent [19]

Oka

[11] Patent Number: 4,659,211

[45] Date of Patent: Apr. 21, 1987

[54] COPYING APPARATUS

[75] Inventor: Tateki Oka, Toyohashi, Japan

[73] Assignee: Minolta Camera Kabushiki Kaisha, Osaka, Japan

[21] Appl. No.: 719,739

[22] Filed: Apr. 3, 1985

[30] Foreign Application Priority Data

Apr. 5, 1984 [JP] Japan ..... 59-68712

[51] Int. Cl.[4] ..... G03G 15/08

[52] U.S. Cl. ..... 355/14 D; 118/657; 355/300

[58] Field of Search ..... 355/3 R, 3 DD, 4, 14 D; 118/657, 658

[56] References Cited

U.S. PATENT DOCUMENTS

| | | | |
|---|---|---|---|
| 3,877,803 | 4/1975 | Seliger | 355/3 R |
| 3,999,849 | 12/1976 | Maksymiak et al. | 355/3 DD |
| 4,077,358 | 3/1978 | Kito | 355/3 DD X |
| 4,166,691 | 9/1979 | Ebi et al. | 355/3 DD X |
| 4,173,405 | 11/1979 | Swapceinski et al. | 355/3 DD |
| 4,235,194 | 11/1980 | Wada et al. | 355/3 DD X |
| 4,264,185 | 4/1981 | Ohta | 355/3 DD X |
| 4,351,604 | 9/1982 | Karasawa et al. | 355/3 DD X |
| 4,354,763 | 10/1982 | Koiso et al. | 355/3 DD X |
| 4,370,053 | 1/1983 | Hirayama et al. | 355/3 DD X |

*Primary Examiner*—Fred L. Braun

*Attorney, Agent, or Firm*—Wenderoth, Lind & Ponack

[57] ABSTRACT

A copying apparatus capable of forming an electrostatic latent image in the form of a positive image and/or a negative image on a photosensitive member for obtaining a positive image copy by developing the electrostatic latent image, is characterized in that there are provided a first developing device for subjecting the electrostatic latent image to regular development through employment of a developing material composed of a mixture of electrically insulative toner, and carrier capable of triboelectrically charging the electrically insulative toner to a polarity opposite to that of the electrostatic latent image, and a second developing device for subjecting the electrostatic latent image to reversal development through employment of a developing material composed of a mixture of the same electrically insulative toner, and carrier capable of triboelectrically charging the electrically insulative toner to the same polarity as that of the electrostatic latent image.

12 Claims, 7 Drawing Figures

COPYING APPARATUS

BACKGROUND OF THE INVENTION

The present invention generally relates to a copying apparatus and more particularly, to construction of a developing means employed for the copying apparatus.

Commonly, in a copying apparatus, for example, a reader printer arranged to effect reading and copying of microfilms, depending on whether the microfilm for an original is of a positive image or a negative image, there are required one system for developing and transferring the positive image as it is, and another system for effecting developing and transferring by inverting the negative image into a positive image.

For meeting the requirements as described above, there have conventionally been employed practices as follows.

(i) A practice in which, through employment of a photosensitive member having sensitivites for both polarities, it is made possible to effect the reversal development by altering the polarity of an electrostatic latent image formed on the photosensitive member.

(ii) A practice in which, by employing electrically conductive magnetic toner, the reversal development is made possible through alteration of a bias voltage.

However, in the known practices as described above, there are disadvantages such that the practice (i) requires the employment of the special photosensitive member, while in the practice (ii), the developed toner image can not be transferred onto a plain paper.

Accordingly, in order to make it possible to transfer developed toner images onto a plain paper sheet through employment of a generally used photosensitive member, without alteration of the charging characteristics thereof, another practice (iii) may be considered, in which two developing means are provided so as to separately accommodate therein positively charged toner and negatively charged toner for effecting selective development by either one of the toners.

However, the above practice (iii) also has a disadvantage as stated below.

(a) The practice is uneconomical, since the toner removed from the photosensitive member after the transfer can not be reused through recycling due to the employment of two kinds of toner.

(b) Owing to the fact that two toner hoppers are provided side by side and the two kinds of toner are both black, there is a possibility that the toner to be replenished or the hopper for the replenishment will be wrongly selected by the operator.

(c) When the fixing conditions are taken into account, two kinds of toner having exactly the same characteristics except for the charging polarity are required, and therefore, selection and manufacture of the toner are difficult.

SUMMARY OF THE INVENTION

Accordingly, an essential object of the present invention is to provide an improved copying apparatus which is capable of eliminating not only the disadvantages inherent in the above conventional practices (i) and (ii), but also the inconvenience as described for the above items (a), (b) and (c) by employing one kind of electrically insulative toner for two kinds of developing means for the regular development and reversal development.

Another important object of the present invention is to provide a copying apparatus of the above described type which is simple in construction and stable in functioning, and can be readily manufactured at low cost.

In accomplishing these and other objects, according to one preferred embodiment of the present invention, there is provided a copying apparatus arranged to form an electrostatic latent image in the form of a positive image and/or a negative image on a photosensitive member for obtaining a positive image copy by developing the electrostatic latent image, and characterized in that there are provided a first developing means for subjecting the electrostatic latent image to regular development through employment of a developing material composed of a mixture of electrically insulative toner, and carrier capable of tirboelectrically charging the electrically insulative toner to a polarity opposite to that of said electrostatic latent image, and a second developing means for subjecting the electrostatic latent image to reversal development through employment of a developing material composed of a mixture of the electrically insulative toner, and carrier capable of triboelectrically charging the electrically insulative toner to the same polarity as that of said electrostatic latent image.

By the arrangement according to the present invention as described above, an improved copying apparatus has been provided, with substantial elimination of the disadvantages inherent in the conventional copying apparatuses of this kind.

BRIEF DESCRIPTION OF THE DRAWINGS

These and other objects and features of the present invenion will become apparent from the following description of preferred embodiments thereof taken in conjunction with the accompanying drawings, in which.

DETAILED DESCRIPTION OF THE INVENTION

Figure 1:
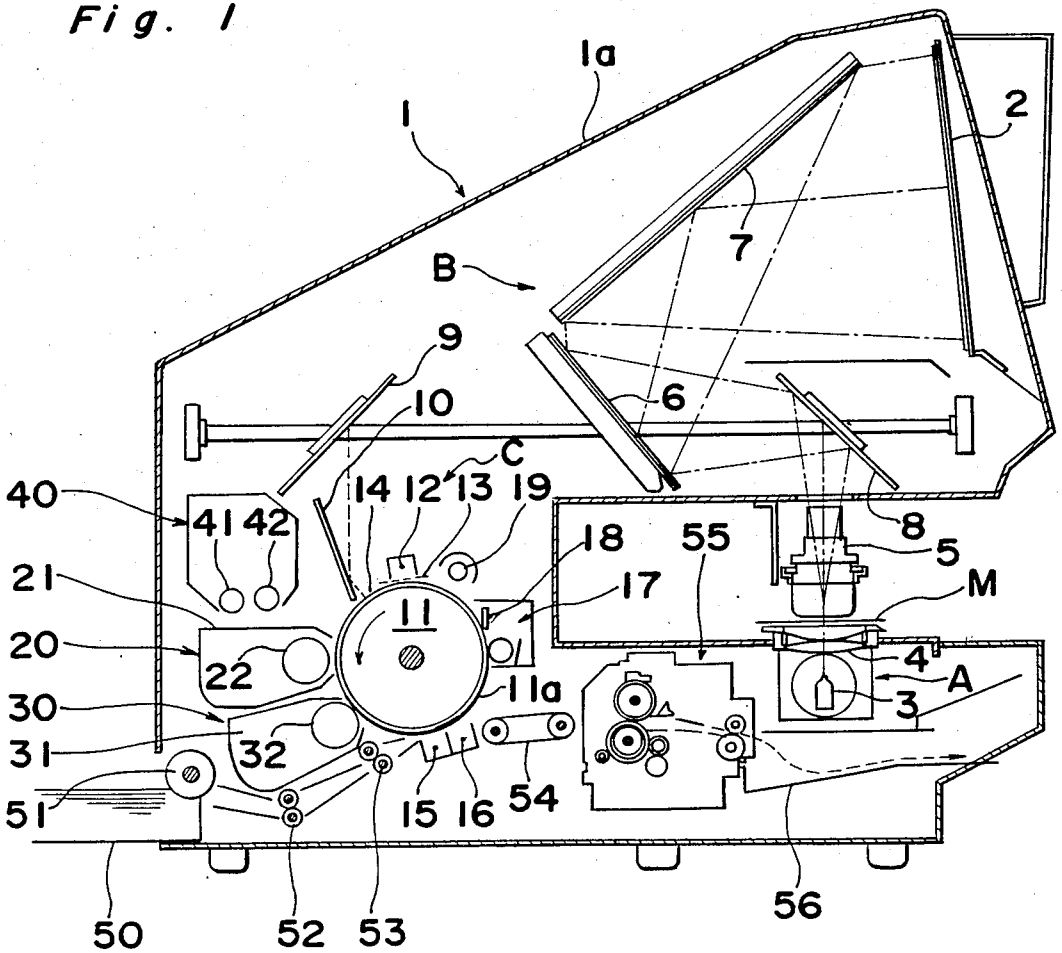
FIG. 1 is a schematic side sectional view showing the general construction of a copying apparatus according to one preferred embodiment of the present invention.

Before the description of the present invention proceeds, it is to be noted that like parts are designated by like reference numerals throughout the accompanying drawings.

Referring now to the drawings, there is shown in FIG. 1 a reader-printer 1 including a copying apparatus according to one preferred embodiment of the present invention, which generally includes an illuminating section A provided at the lower right portion for illuminating microfilm M, an optical system section B provided at the upper portion for projecting an image of the microfilm M selectively onto an observation screen 2 or a photosensitive or photoreceptor drum 11, and a printer section C including the photoreceptor drum 11 and provided at the lower left portion of the apparatus housing 1*a*.

The illuminating section A is constituted by a light source 3 accommodated in a casing and a condenser lens 4 provided above the light source 3.

The optical system section B includes a projecting lens assembly 5, a screen projecting system having a swing mirror 6 and a stationary mirror 7 for directing the light image onto the observation screen 2, and a scanning/projecting system provided with first and second scanning mirrors 8 and 9 and a stationary mirror 10. For projecting the image onto the observation screen 2, the scanning mirrors 8 and 9 and the swing mirror 6 are located in positions indicated by solid lines, and the light image of the microfilm M is directed onto the observation screen 2 by the first scanning mirror 8, the swing mirror 6, and the stationary mirror 7. On the other hand, for effecting the copying operation, the swing mirror 6 retracts upwardly, and the scanning mirrors 8 and 9 move leftwards at equal speed after having been once displaced rightwards in FIG. 1 for slit exposure of the image onto the photoreceptor drum 11.

In the printer section C, the photoreceptor drum 11 is rotatably disposed generally at a central portion for rotation in the counterclockwise direction, while various processing stations such as a corona charger 12 having a grid 13, an exposure slit 14, a regular developing means 20, a reversal developing means 30, a transfer charger 15, a separating charger 16, a cleaner 17 for removing residual toner, and an eraser lamp 19 for erasing residual charge, etc. are sequentially disposed around the photoreceptor drum 11 as illustrated.

More specifically, while rotating in the counterclockwise direction, the photoreceptor drum 11 is charged, on its photosensitive surface 11*a*, with a charge of predetermined polarity and potential by the corona charger 12, and is then exposed to the light image of the microfilm M by the scanning/projecting system described earlier so as to form an electrostatic latent image of the microfilm M on said surface 11*a*. The latent image thus formed on the photosensitive surface 11*a* is developed selectively by the regular developing means 20 or the reversal developing means 30 in a manner to be described in more detail later, and is subsequently brought into a transfer region.

On the other hand, copy paper sheets accommodated in a paper feed cassette 50 provided at the left lower portion in FIG. 1 are fed rightwards, one sheet by one sheet, by a paper feed roller 51 towards a pair of timing rollers 53 through feed-out rollers 52 for standing-by at the timing roller 53. Subsequently, the copy paper sheet is transported to the transfer region from the timing rollers 53 in a timed relation with respect to the image on the photoreceptor drum 11 so as to be transferred with the developed toner image through corona discharge by the transfer charger 15. Thereafter, the copy paper sheet is transported through a transport belt 54 to a fixing device 55 where the toner image is fixed onto the copy paper sheet which is then discharged onto a tray 56.

The photoreceptor drum 11 is continuously rotated so that the residual toner is removed from its photosensitive surface 11*a* by a blade 18 of the cleaner 17, and also the charge remaining on the surface 11*a* is erased through light irradiation by the eraser lamp 19 so as to prepare for a subsequent copying.

Subsequently, a description will be given of the developing by which the present invention is characterized.

According to the present invention, in any case where the original (i.e., microfilm M) is of a positive image or negative image, charge of a predetermined polarity is imparted onto the photosensitive surface 11*a* of the photoreceptor drum 11, while the one kind of electrically insulative toner employed is charged to either positive or negative polarity within the developing means 20 or 30 for selectively effecting the developing by either the positively charged toner or negatively charged toner, depending on whether the original is a positive image or a negative image so as to consequently obtain a positive copied image.

According to the present invention, an Se group photoreceptor is employed, and charged to a positive polarity by the corona charger 12. Therefore, in the regular developing means 20 for effecting the developing with respect to the positive image, the insulative toner is charged to a negative polarity, whereas in the reversal developing means 30 for effecting the developing with respect to the negative image, the insulative toner is charged to a positive polarity, thereby to carry ot the developing selectively.

The transfer charger 15 is capable of changing over the discharging polarities, and during the regular developing, effects the discharge of the positive polarity for transfer of the toner image of the negative polarity onto the copy paper sheet, while during the reversal developing, carries out the discharge of the negative polarity so as to transfer the toner image of the positive polarity onto the copy paper sheet.

Hereinbelow, the construction and function of the developing means 20 and 30 will be described.

In the first place, it is to be noted that the developing means 20 and 30 fundamentally have a construction similar to each other, and that, although the regular developing means 20 will be mainy described subsequently with reference to FIGS. 2 and 4, the explanation generally applies also to the reversal developing means 30.

The regular developing means 20 generally includes a developing tank 21 provided adjacent to the photoreceptor drum 11, a developing sleeve 22 rotatably provided within the tank 21 so as to confront the photosensitive surface 11*a* of the photoreceptor drum 11 through an opening in the tank 21, a magnet roll 23 fixedly provided within the developing sleeve 22, and a front spiral member 24 and a rear spiral member 25 rotatably provided within the tank 21 in a direction parallel to the developing sleeve 22. The magnet roll 23 is a stationary type, while the developing sleeve 22 is connected to a motor 60 (FIG. 4) through gears 61 and 62 for rotation in the clockwise direction in FIG. 2, and is provided with a developing bias applying means (not shown). The front spiral member 24 and rear spiral member 25 are connected to a motor 63 through gears 64, 65 and 66 so that the front spiral member 24 is rotated in the clockwise direction, while the rear spiral member 25 can be rotated in the counterclockwise direction. Moreover, a toner supply spiral member 26 is mounted on the same shaft as the rear spiral member 25 (FIG. 4).

Figure 4:
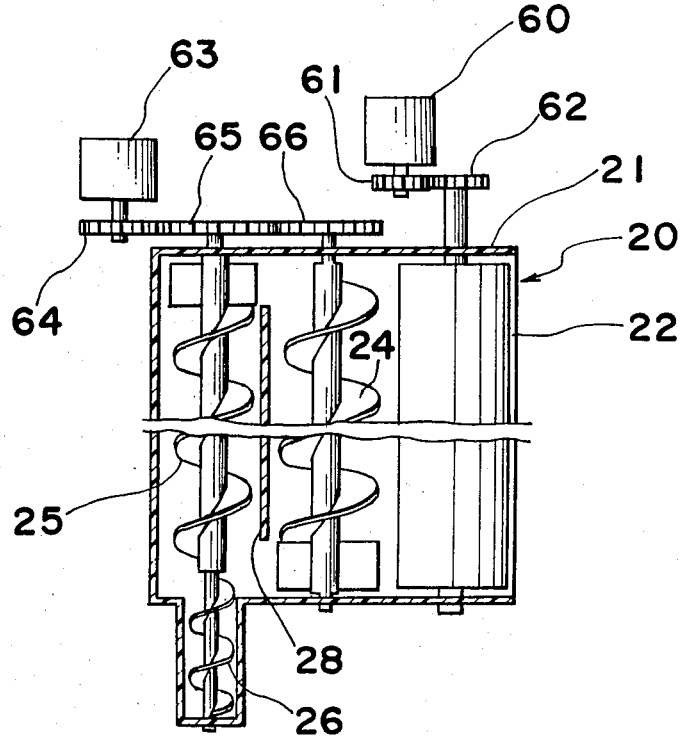
FIG. 4 is a horizontal cross section of a regular developing means employed in the arrangement of FIG. 1.

Furthermore, a bristle height restricting plate 27 for restricting the height of magnetic brush bristles is provided on the under surface of the top wall of the developing tank 21, with the lower edge of the plate 27 being directed close to the photosensitive surface 11*a* of the drum 11, while the interior of the tank 21 between the front and rear spiral members 24 and 25 is sectioned by a partition wall 28 cut off at its opposite ends as shown in FIG. 4.

As state earlier, the reversal developing means 30 has a construction generally similar to that of the regular developing means 30 described so far, and generally includes a developing tank 31 provided adjacent to the photoreceptor drum 11, a developing sleeve 32 rotatably provided within the tank 31 so as to confront the photosensitve surface 11*a* of the photoreceptor drum 11 through an opening in the tank 31, a magnet roll 33 fixedly provided within the developing sleeve 32, a bristle height restricting plate 37 provided on the under surface of the top wall for the tank 31, a front spiral member 34 and a rear spiral member 35 rotatably provided within the tank 31 in a direction parallel to the developing sleeve 32, and a partition wall 38 provided in the interior of the tank 31 in a position between the spiral members 34 and 35 in a similar manner as in the regular developing means 20.

On the other hand, in a position immediately above the regular developing means 20, there is provided a toner hopper 40 which includes a casing 40*a* for accommodating replenishing toner therein, first and second replenishing spiral members 41 and 42 rotatably provided for rotation in the clockwise direction, in the lower portion of the casing 40*a* side by side with a partition wall 40*b* formed therebetween, and stirring rods 45 also rotatably provided within the casing 40*a* for preventing undesirable crosslinking phenomenon, blocking, etc. of the replenishing toner.

Figure 5:
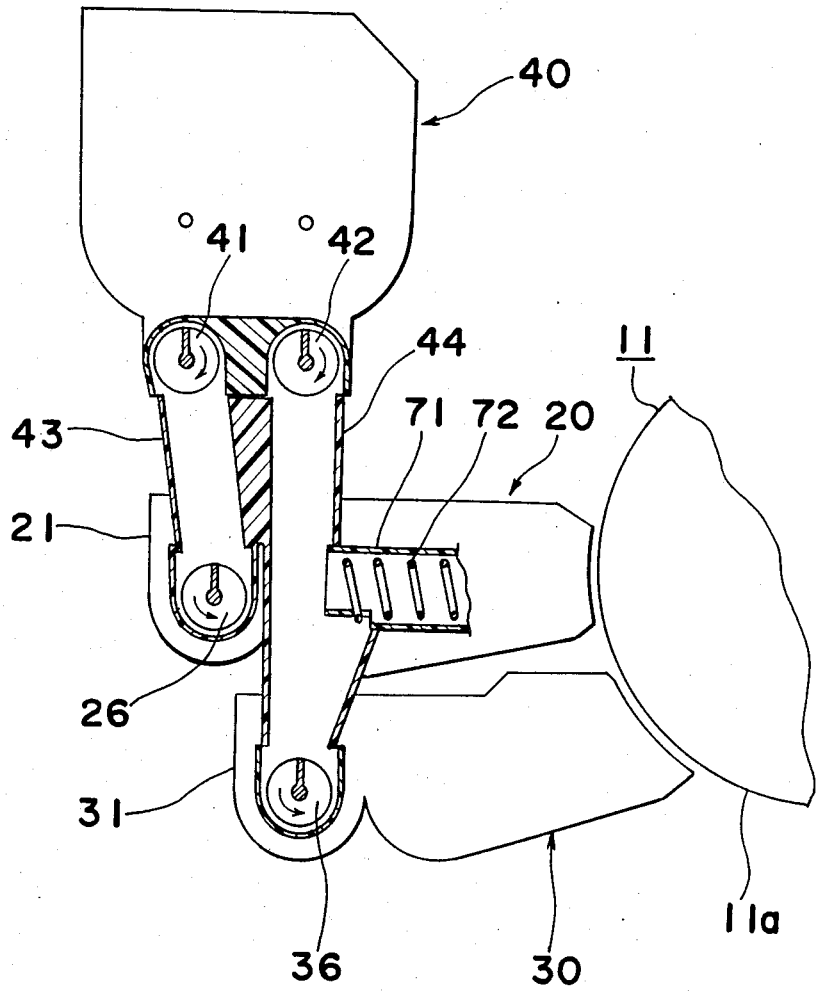
FIG. 5 is a vertical cross section of a toner replenishing portion employed in the arrangement of FIG. 1.

As shown in FIG. 5, the first and second replenishing spiral members 41 and 42 are respectively communicated with the toner supply spiral members 26 and 36 of the developing means 20 and 30 through toner guides 43 and 44.

Hereinbelow, developing materials to be employed in the present invention will be specifically explained.

| Electrically insulative toner: | |
|---|---|
| Styrene-acrylic polymer "HYMER-SBM73" (named used in trade and manufactured by Sanyo Chemical Industries, Ltd. of Japan) | 100 parts by weight |
| Carbon black "MA #100" (name used in trade and manufactured by Mitsubishi Chemical Industries, Ltd. of Japan) | 8 parts by weight |

The above materials were melted for mixing and after cooling, ground and classified to obtain toner having an average particle diameter of 12 μm, which was then uniformly mixed with 0.3 parts by weight of colloidal silica (Aerosil R-972" (name used in trade and manufactured by Nippon Aerosil Co., Ltd. of Japan), with a subsequent surface treatment.

| Carrier A: | |
|---|---|
| Styrene-acrylic polymer "HYMER-SBM73" (referred to above) | 100 parts by weight |
| Magnetic fine particles "MAGNETITE RB-BL" (name used in trade and manufactured by Chitan Kogyo Kabushiki Kaisha of Japan) | 200 parts by weight |
| Charging control dye "NYGROSINE-EX (name used in trade and manufactured by Orient Chemical Ltd. of Japan) | 4 parts by weight |

The above materials were melted for mixing, and after cooling, ground and classified to obtain carrier A with an average particle diameter of 35 μm.

| Carrier B: | |
|---|---|
| Polyester resin | 100 parts by weight |
| Non-linear saturated polyester | |
| Number-average molecular weight | 12,000 |
| Weight-average molecular weight | 220,000 |
| Glass point | 62° C. |
| Magnetic fine particles "MAGNETITE RB-BL" (referred to above) | 200 parts by weight |

The above materials were melted for mixing and after cooling, ground and classified to obtain carrier B with an average particle diameter of 38 μm.

In the developing tank 21 of the regular developing means 20, the electrically insulative toner and carrier A as described above are accommodated at a weight ratio of 8:92. In the developing tank 31 of the reversal developing means 30, the electrically insulative toner and carrier B are accommodated also at a weight ratio of 8:92.

Within the developing tanks 21 and 31, the respective developing materials as described above are stirred and transported upwardly in FIG. 4 by the counterclockwise rotation of the rear spiral members 25 and 35, while being stirred and transported downwardly by the clockwise rotation of the front spiral members 24 and 34 for circulation around the partition plates 28 and 38.

In the above case, since the positively charging dye is contained in carrier A, the electrically insulative toner is triboelectrically charged to a negative polarity. At this time, the amount of charge on the toner is −13 μc/g. On the other hand, owing to a characteristic of storing negative charge possessed by the polyester resin contained in carrier B, the electrically insulative toner is triboelectrically charged to a positive polarity. At this time, the amount of charge on the toner is +15 μc/g.

Accordingly, by selectively operating the developing means 20 or 30, i.e., by actuating the regular developing means 20 if the microfilm M is a positive image, and the reversal developing means 30 if it is a negative image, the developing material is transported over the outer peripheral surface of the developing sleeve 22 or 32 in the clockwise direction through rotation of said developing sleeve, and develops the electrostatic latent image formed on the photosensitive surface 11*a* of the photoreceptor drum 11 into a visible toner image. In the above process, the amount of developing material transported by the bristle height restricting plate 27 or 37 is restricted, and after the developing, the excess is scraped off the outer peripheral surface of the developing sleeve 22 or 32 at the portion of the magnet roll 23 or 33 magnetized by the same polarity and confronting the front spiral member 24 or 34 so as to be replaced by a fresh developing material.

For the control of the developing means 20 and 30, it is so arranged, for example, that by the operation of a change-over switch for the regular developing and reversal developing provided on a control panel (not shown), a selected one of the developing means 20 and 30 is actuated, with a simultaneous change-over of voltage values of the developing bias to be impressed on the developing sleeve 22 or 32. By way of example, during the regular developing, a developing bias (+150 V) slightly higher than the potential at the non-image portion (+100 V: potential at the image portion is +600 V) of the electrostatic latent image is applied to the developing sleeve 22 during the rotating so as to prevent undesirable fogging of toner, while a developing bias (+50 V) somewhat lower than the potential at the non-image portion of the electrostatic latent image is impressed on the developing sleeve 32 which is in the stationary state to prevent the positively charged toner from adhering thereto. On the other hand, during the reversal developing, a developing bias (+550 V) slightly lower than the potential at the non-image portion (+600 V: potential at the image portion is +100 V) of the electrostatic latent image is applied to the rotating developing sleeve 32 for prevention of toner fogging, while a developing bias (+650 V) slightly higher than the potential at the non-image portion of the electrostatic latent image is impressed on the developing sleeve 22 which is at rest so as to prevent adhesion of the negatively charged toner. It is to be noted here that the control of the developing means 20 and 30 as described above may be so modified that either one of the developing means 20 or 30 is retracted to an inoperative position spaced from the surface 11*a* of the photoreceptor drum 11. In this case, impression of a developing bias on the developing sleeve of the developing means located at the inoperative position is not necessarily required.

The electrically insulative toner referred to earlier is accommodated in the toner hopper 40 for replenishment, and is transported forwardly (i.e., towards a reader in FIG. 5) by the clockwise rotation of the first and second replenishing spiral members 41 and 42 in FIG. 5 so as to be dropped onto the portions of the toner supply spiral members 26 and 36 of the developing means 20 and 30 through the toner guides 43 and 44, and is subsequently fed into the developing tanks 21 and 31 by the counterclockwise rotation of the spiral members 26 and 36, i.e., into the portions of the rear spiral members 25 and 35.

The first replenishing spiral member 41 is actuated only during the normal developing, while the second replenishing spiral member 42 is operated only during the reversal developing.

Moreover, according to the present embodiment, there is additionally provided a toner recycle means which is arranged to return the residual toner scraped off the photosensitive surface 11*a* of the photoreceptor drum 11 by the blade 18 of the cleaner 17 after the transfer, into the toner hopper 40, developing tank 21 or 31 or replenishing passage for reuse. The recycling as described above is possible only in the copying apparatus which employs one kind of electrically insulative toner as in the present invention, even when separate developing means are provided for the regular developing and reversal developing.

Figure 2:
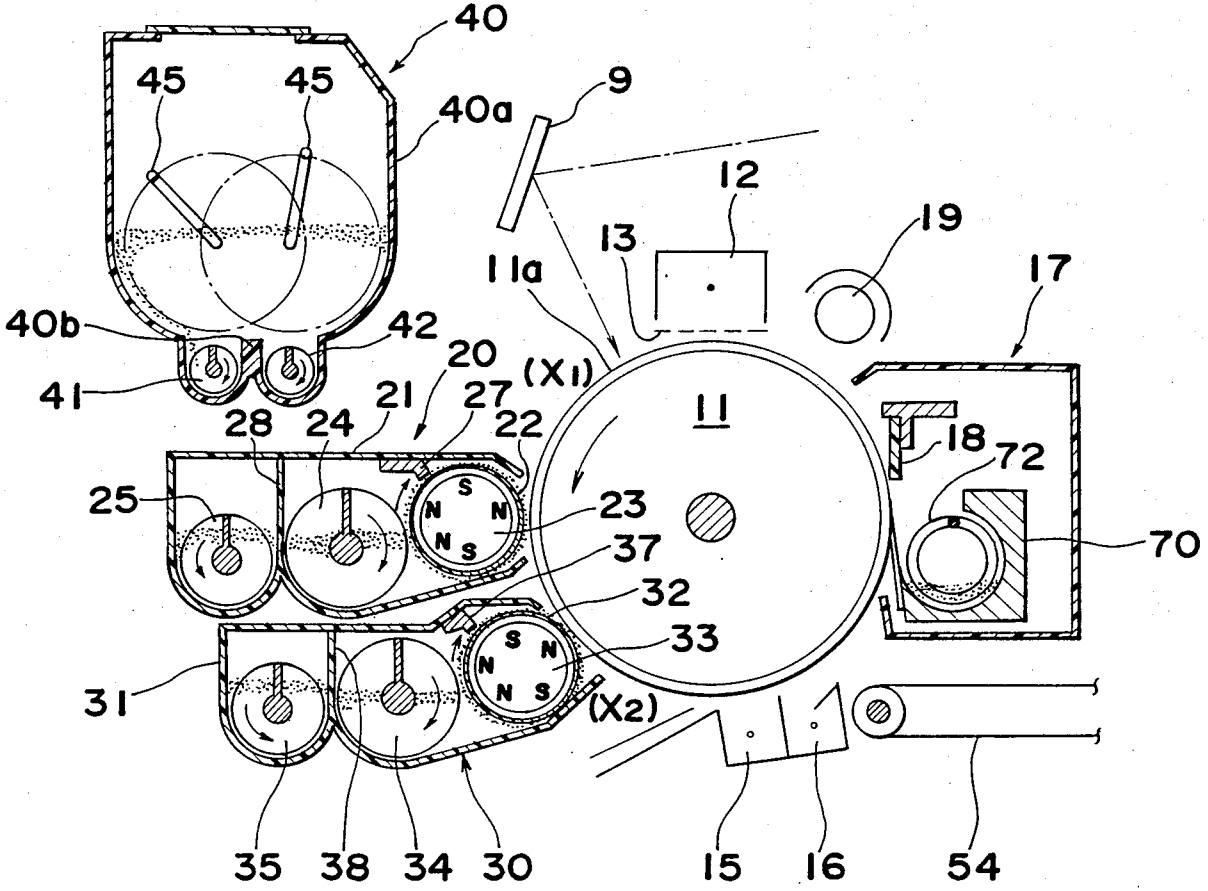
FIG. 2 is a side sectional view showing on an enlarged scale, an essential portion in the copying apparatus of FIG. 1.
Figure 3:
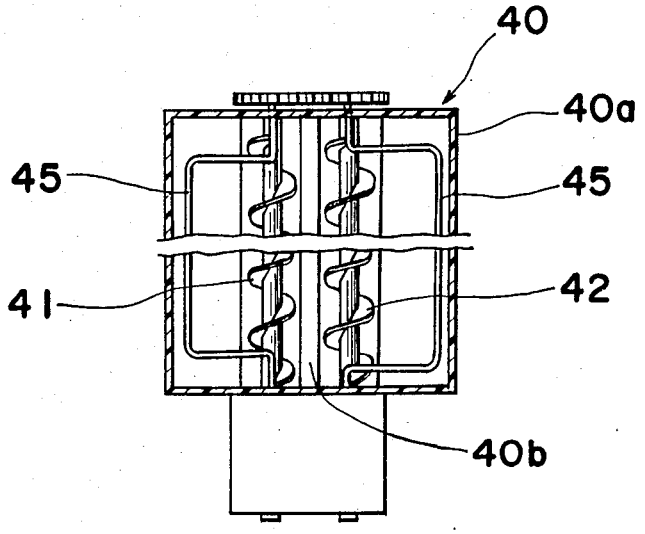
FIG. 3 is a horizontal cross section of a toner hopper employed in the arrangement of FIG. 1.

More specifically, as shown in FIG. 2, a receiving member 70, for receiving the residual toner scraped off by the blade 18, is provided in the cleaner 17, and one end of a recycle tube 71 (FIG. 5) communicated with a corresponding one end of this receiving member 70 is fixed to a side portion of said toner guide 44, on a recycle coil 72 is provided on the recycle tube 71 along the entire length thereof from the receiving member 70. The recycle coil 72 is driven for rotation by a driving means (not shown).

Accordingly, the toner scraped off the surface 11*a* of the photoreceptor drum 11 by the blade 18 falls onto the receiving member 70, and is transported through the interior of the recycle tube 71 by the rotation of the recycle coil 72 so as to be recirculated to the reversal developing means 30 via the toner dropping guide 44.

Figure 6:
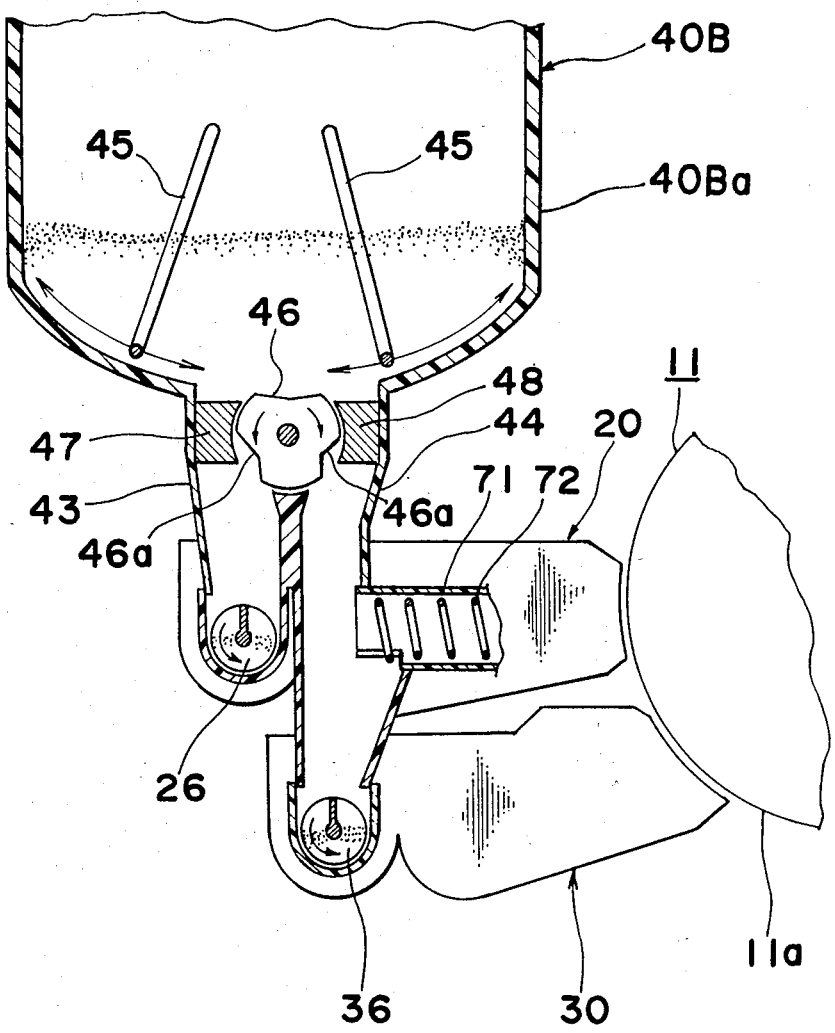
FIG. 6 is a cross section showing a modification of the toner hopper.

Referring to FIG. 6, there is shown a modification of the toner hopper 40 shown in FIG. 5.

In the modified toner hopper 40B in FIG. 6, the first and second replenishing members 41 and 42 described as employed in the arrangement of FIG. 5 are replaced by a measuring roller 46 disposed between measuring members 47 and 48 at the lower portion of the casing 40B*a* and adapted to be rotatable in the forward and reverse directions. The measuring roller 46 is formed with notches 46*a* at three places on its outer peripheral surface, and the toner filled in these notches 46*a* is measured by the measuring member 47 during counterclockwise rotation of the roller 46 and is supplied to the regular developing means 20, while it is measured by the measuring member 48 during clockwise rotation of the roller 46 and is supplied to the reversal developing means 30. Accordingly, the measuring roller 46 is driven for rotation in the counterclockwise direction during the regular developing, and in the clockwise direction during the reversal developing.

On the other hand, in the case where the so-called synthetic electrostatic latent image forming method (synthetic copying system) is to be effected in which the regular developing and the reversal developing are carried out in a parallel relation through employment of the developing means 20 and 30 as described in the embodiment of the present invention, it may be so arranged that a light emitting diode array (not shown) is disposed at a position indicated by ($X_1$) in FIG. 2, while a transfer pre-charger (not shown) is further provided at a position indicated ($X_2$). More specifically, from the stationary mirror 10 referred to earlier, the exposure for the positive image is effected so as to first form a positive electrostatic latent image having an image portion potential of +600 V and a non-image portion potential of +300 V, and thereafter the exposure for the negative image is overlapped thereover from the light emitting diode array, thereby to further form a negative electrostatic latent image having an image portion potential of about +50 V and a non-image portion potential of about +300 V, and then the developing means 20 and 30 are simultaneously operated, thereby to develop the positive image portion with the negatively charged toner by the regular developing means 20 supplied with a developing bias at +350 V with respect to the developing sleeve 22, and the negative image portion with the positively charged toner by the reversal developing means 30 supplied with a developing bias of +250 V with respect to the developing sleeve 32.

The positively charged toner and negatively charged toner as referred to above are adapted to have the predetermined polarities due to the discharging phenomenon at specified polarities of the transfer pre-charger, and are transferred onto the copy paper sheet by the discharging phenomenon by the opposite polarity of the transfer charger 15.

It is to be noted here that, for effecting the above system, although the negatively charged toner of the regular developing means 20 may possibly be mixed into the reversal developing means 30, there is no harm done even if it is mixed thereinto, since the toner itself is the same kind.

Figure 7:
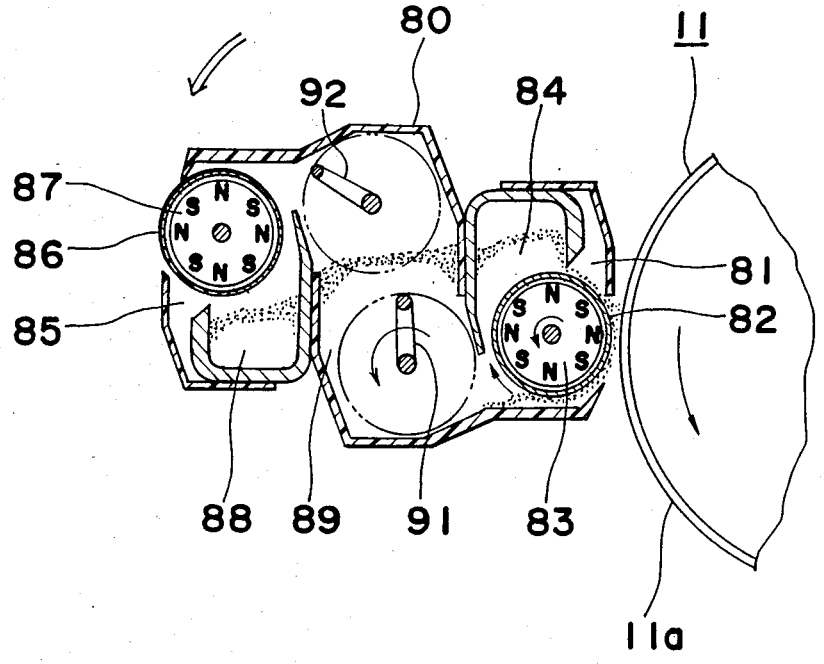
FIG. 7 is a vertical cross section showing a developing means according to another embodiment of the present invention.

Referring further to FIG. 7, there is shown another embodiment of the developing arrangement according to the present invention in which two kinds of the developing means are combined into one unit at a point symmetry of 180° for rotation through an angle of 180°. The developing arrangement includes a developing tank 80 divided into developing chambers 81 and 85 provided at opposite sides and a toner hopper 89 at the central portion, developing sleeves 82 and 86 incorporated therein with magnet rolls 83 and 87 and respectively provided in the developing chambers 81 and 85, toner supply vanes 91 and 92 rotatably provided in the central toner hopper 89 for rotation in the counterclockwise direction, and carrier sumps 84 and 88 which are located above the developing sleeves 82 and 86 when said developing sleeves 82 and 86 confront the photoreceptor drum 11. The developing sleeves 82 and 86 are adapted to be driven for rotation in the clockwise direction at a comparatively low speed, while the magnet rolls 83 and 87 are arranged to be driven for rotation in the counterclockwise direction at a comparatively high speed.

For the carriers to be loaded in the carrier sumps 84 and 88, carriers A and B similar to those in the previous embodiment are employed, and carrier A filled in carrier sump 84 is placed on the outer peripheral surface of the developing sleeve 82 in a predetermined amount, while carrier B filled in carrier sump 88 is applied onto the outer peripheral surface of the developing sleeve 86 in a predetermined amount respectively.

For the toner, electrically insulative magnetic toner as follows is employed.

| | |
|---|---|
| Styrene-acrylic polymer "HYMER-SBM73" (referred to earlier) | 100 parts by weight |
| Carbon black "MA #100" (referred to earlier) | 4 parts by weight |
| Magnetic fine particles "MAGNETITE RB-BL" (referred to earlier) | 20 parts by weight |

The above materials were melted for mixing and after cooling, ground and classified to obtain toner having an average particle diameter of 12 μm, which was then uniformly mixed with 0.3 parts by weight of colloidal silica, with a subsequent surface treatment.

The above electrically insulative magnetic toner is accommodated in the hopper portion 89, and, for example, when the regular developing is to be effected, with the electrical charging with respect to the photoreceptor drum 11 being of the positive polarity in a similar manner as in the previous embodiment, the developing sleeve 82 provided with carrier A is caused to confront the photoreceptor drum 11 (FIG. 7), and the developing sleeve 82 is rotated in the clockwise direction, while the magnet roll 83 is rotated in the counterclockwise direction. The toner is mainly transported for circulation clockwise over the outer peripheral surface of the developing sleeve 82 based on the counterclockwise rotation of the magnet roll 83 so as to be formed into the developing material through stirring and mixing with carrier A as it passes through carrier sump 84, and is triboelectrically charged to the negative polarity through contact with carrier A for developing the electrostatic latent image formed as a positive image of a positive polarity.

On the other hand, for effecting the reversal development, the whole developing arrangement is rotated through 180° in the counterclockwise direction so as to cause the developing sleeve 86 provided with carrier B to confront the photoreceptor drum 11, and the developing sleeve 86 and the magnet roll 87 are driven for rotation in a similar manner as before. In this case, the toner is similarly transported over the outer peripheral surface of the developing sleeve 86 in the clockwise direction so as to be triboelectrically charged to the positive polarity through contact with carrier B, and develops the electrostatic latent image formed as a negative image of a positive polarity.

As is clear from the foregoing description, according to the present invention, the copying apparatus which is capable of forming an electrostatic latent image in the form of a positive image and/or a negative image on the photosensitive member for obtaining a positive image copy by developing the electrostatic latent image, is provided with the first developing means for subjecting the electrostatic latent image to regular development through employment of the developing material composed of the mixture of electrically insulative toner, and carrier capable of triboelectrically charging the electrically insulative toner to a polarity opposite to that of said electrostatic latent image, and the second developing means for subjecting the electrostatic latent image to reversal development through employment of a developing material composed of a mixture of the electrically insulative toner, and carrier capable of triboelectrically charging the electrically insulative toner to the same polarity as that of said electrostatic latent image. Since one kind of insulative toner is employed, one toner hopper is sufficient for holding replenishment toner and thus, such disadvantages that the replenishing toner is wrongly selected or characteristics of toner must be aligned as in the csse where two kinds of toner are employed, have been eliminated and it also becomes possible to resuse the residual toner for economical recycling applications.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as included therein.

What is claimed is:

1. In a copying apparatus arranged for forming an electrostatic latent image in the form of a positive image or a negative image on a photosensitive member for obtaining a positive image copy by developing the electrostatic latent image, the improvement comprising:

a first developing means for subjecting the electrostatic latent image to regular development by employment of a developing material composed of a mixture of electrically insulative toner, and carrier capable of triboelectrically charging the electrically insulative toner to a polarity opposite to that of said electrostatic latent image, and a second developing means for subjecting the electrostatic latent image to reversal development by employment of a developing material composed of a mixture of the electrically insulative toner, and carrier capable of triboelectrically charging the electrically insulative toner to the same polarity as that of said electrostatic latent image, the respective carriers being carriers capable of charging the same insulative toner to respective opposite polarities, whereby the same toner can be used in both developing means.

2. A copying apparatus which comprises an image forming means for forming a positive electrostatic latent image or a negative electroststic latent image on a photosensitive member, a first developing means for subjecting the positive electrostatic latent image to regular development by employment of a developing material composed of a mixture of electrically insulative toner, and carrier capable of triboelectrically charging the electrically insulative toner to a polarity opposite to that of said electrostatic latent image, a second developing means for subjecting the negative electrostatic latent image to reversal development by employment of a developing material composed of a mixture of the electrically insulative toner, and carrier capable of triboelectrically charging the electrically insulative toner to the same polarity as that of said electrostatic latent image, a single toner supply means for accommodating a single electrically insulative toner therein which is capable of being triboelectrically charged to respective opposite polarities by the respective carriers and for supplying said electrically insulative toner both to said first developing means and to said second developing means, a control means for causing said first developing means and said second developing means selectively to function, and a transfer means for transferring the image developed by said first or second developing means onto transfer paper.

3. A copying apparatus as claimed in claim 2, wherein said image forming means further includes a charging means for electrically charging said photosensitive member to a predetermined polarity, and means for subjecting the positive or negative image to image exposure.

4. A copying apparatus as claimed in claim 2, wherein said toner supply means further includes first and second toner replenishing means for supplying toner respectively to said first and second developing means.

5. A copying apparatus as claimed in claim 4, wherein said toner supply means further includes a single hopper, in which the electrically insulative toner is accommodated and adapted to be supplied to said first and second developing means by said first and second toner replenishing means.

6. A copying apparatus as claimed in claim 5, wherein said toner supply means further includes a toner recycle means for removing residual toner from said photosensitive member and returning the residual toner to said hopper.

7. A copying apparatus as claimed in claim 4, wherein said control means comprises means for causing said first developing means to function when the positive electrostatic latent image is to be developed, and also for applying a bias voltage rather higher than a potential at a non-image portion to a developing electrode thereof, while maintaining said second developing means in a non-functioning condition.

8. A copying apparatus as claimed in claim 4, wherein said control means comprises means for causing said second developing means to function when the negative electrostatic latent image is to be developed, and also for applying a bias voltage rather lower than a potential at a non-image portion to a developing electrode thereof, while maintaining said first developing means in a non-functioning condition.

9. A copying apparatus as claimed in claim 2, wherein said toner supply means further includes a single hopper in which the electrically insulative toner is accommodated, and a toner replenishing means at the lower portion of said hopper for supplying toner to said first and second developing means.

10. A copying apparatus as claimed in claim 9, wherein said toner replenishing means further includes two measuring members and a measuring roller disposed therebetween and rotatable in the forward and reverse directions.

11. A copying apparatus as claimed in claim 9, wherein said toner supply means further includes a toner recycle means for removing residual toner from said photosensitive member and returning the residual toner to said hopper.

12. A copying apparatus as claimed in claim 2 wherein said toner supply means further includes a toner recycle means for removing residual toner from said photosensitive member and returning the residual toner to at least one of said developing means.

* * * * *